United States Patent [19]

Leggett

[11] Patent Number: 4,846,272

[45] Date of Patent: Jul. 11, 1989

[54] DOWNHOLE SHUTTLE VALVE FOR WELLS

[75] Inventor: Henry H. Leggett, Setia Mansion, Singapore

[73] Assignee: Eastern Oil Tolls Pte, Ltd., Jurong Town, Singapore

[21] Appl. No.: 233,422

[22] Filed: Aug. 18, 1988

[51] Int. Cl.[4] ..... E21B 34/10; E21B 43/12

[52] U.S. Cl. ..... 166/126; 166/142; 166/317; 166/318; 166/321; 166/323

[58] Field of Search ..... 166/126, 142, 185, 133, 166/188, 321, 332, 72, 317, 318, 323

[56] References Cited

U.S. PATENT DOCUMENTS

| | | | |
|---|---|---|---|
| 3,098,526 | 7/1963 | Heron | 166/133 X |
| 3,493,052 | 2/1970 | Evans et al. | 166/332 X |
| 3,664,415 | 5/1972 | Wray et al. | 166/321 X |
| 3,897,825 | 8/1975 | Tansch | 166/321 X |
| 3,930,540 | 1/1976 | Holden et al. | 166/332 X |
| 4,502,537 | 3/1985 | Carter, Jr. | 166/332 X |
| 4,603,741 | 8/1986 | Edgmon | 166/317 X |
| 4,633,952 | 1/1987 | Ringgenberg | 166/250 X |
| 4,693,314 | 9/1987 | Wesson et al. | 166/317 |

*Primary Examiner*—Hoang C. Dang

*Attorney, Agent, or Firm*—James L. Jackson & Associates

[57] ABSTRACT

A downhole flow testing valve having a tubular housing with a valve and flow tube movable within the housing between an open position where valve ports therein are positioned in registry and a closed position where the valve ports are out of fluid communicating registry. The valve and flow tube is closed by a resultant force developed by compressed gas and opened by pressure introduced into the valve from the annulus between the valve and well casing. The normally closed flow testing shuttle valve is secured in its closed and safe condition during installation by a hydraulically locked sleeve valve. Upon fracture of a break plug by an implement dropped through the straight through flow passage of the flow tube hydraulic fluid captured within a locking chamber is released from the locking chamber by the force of a compression spring.

19 Claims, 6 Drawing Sheets

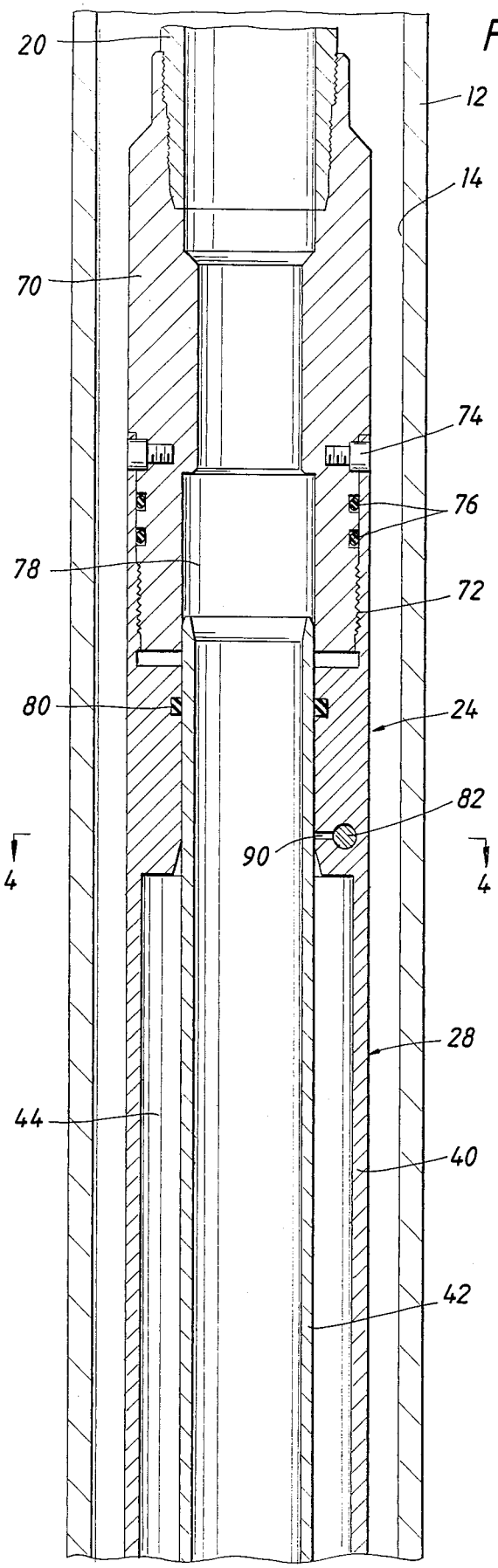
FIG. 3A
FIG. 4
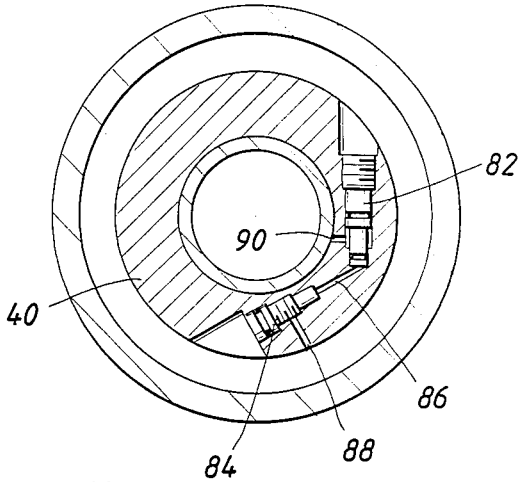
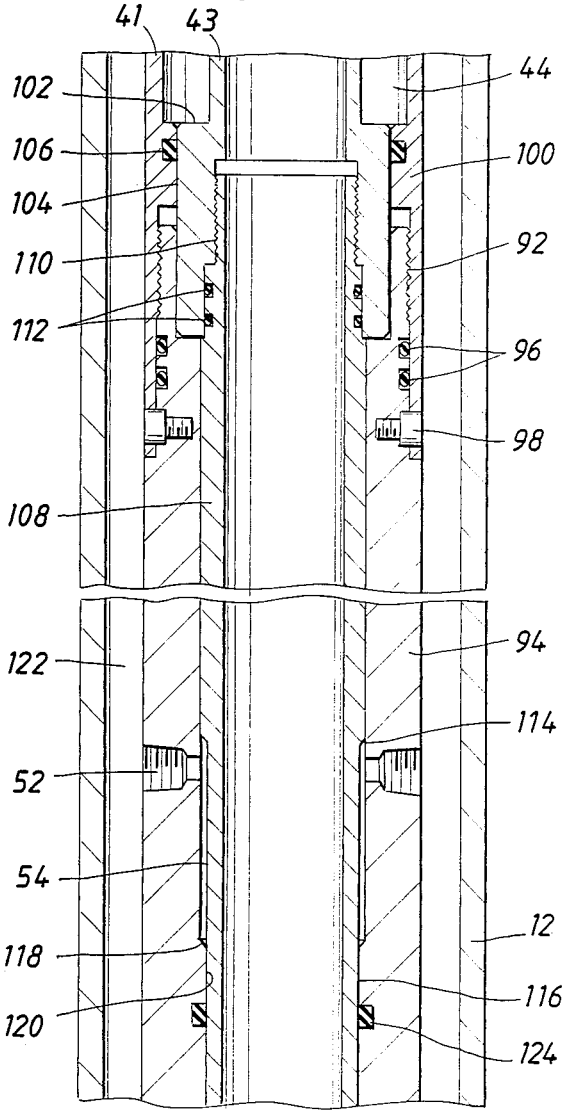
FIG. 3B

FIG. 6C
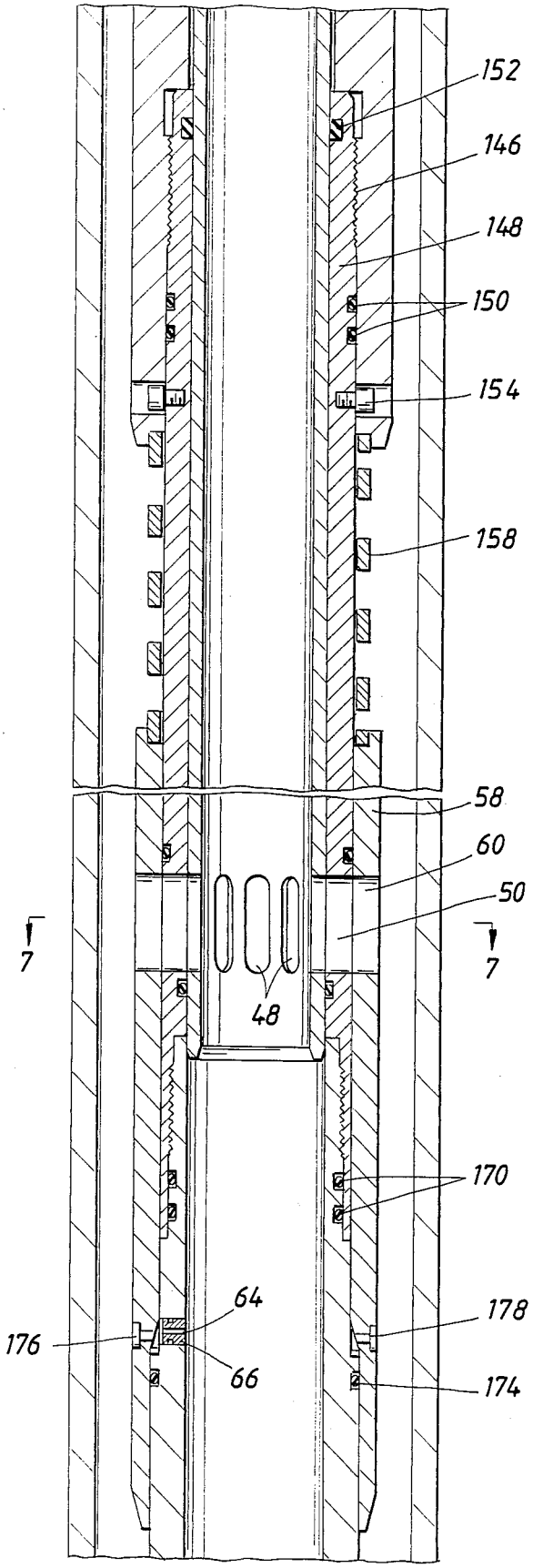
FIG. 5
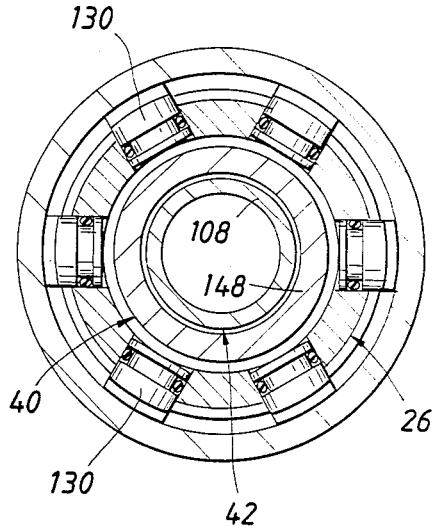
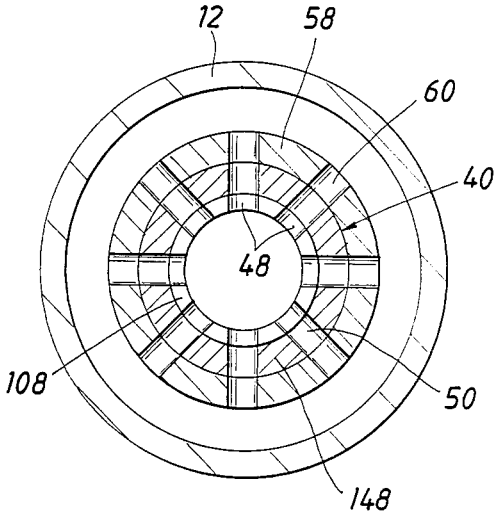
FIG. 7

DOWNHOLE SHUTTLE VALVE FOR WELLS

FIELD OF THE INVENTION

This invention relates generally to a downhole valve mechanism for drill stem testing for both straight and deviated wells that are typically drilled for the purpose of producing petroleum products such as oil and gas. More specifically, the present invention is directed to a shuttle valve mechanism for downhole application that will fail in a safe mode and accomplish downhole shut-in of the well in the event predetermined conditions develop during well testing. Even more specifically, this invention is directed to a downhole shuttle valve mechanism that utilizes compressed nitrogen or other gas as the motive force for accomplishing valve closure to render the well safe even under conditions where the valve closes responsive to maximum flow conditions of the well.

BACKGROUND OF THE INVENTION

During well testing procedures after a well has been drilled and completed. The well is typically flowed under a wide range of flow conditions, including the condition of maximum flow. Wells that have been completed may not flow to the surface due to insufficient formation pressure or formation pressure may be considerable to thus induce flow of petroleum products at an extremely high rate. For example, it is not unusual for wells to flow at a maximum rate of 4,000 barrels of oil per day during flow testing. It is necessary, therefore, to provide a testing valve mechanism that is capable of functioning properly at a wide range of well flow conditions, including conditions of extremely high flow rate. In every case, it is necessary that the valve mechanism be capable of absolutely shutting in the well when valve closure is accomplished.

In the past, various types of downhole valve mechanisms have been employed during well testing activities. The typical valve employed for this service is a conventional annulus pressure operated drill string testing tool. Such tools typically have the disadvantage that tubing conveyed perforation activities can not be carried out with initial reservoir pressure measurements taken before opening the downhole valve. It is desirable to provide a shuttle valve mechanism that enables tubing conveyed operations to be carried out either by a drop bar mechanism or by means of an electrical wet connector. Annulus pressure operated DST valves typically function as normally open valves which are operated by application of annulus pressure. For greater efficiency and better safety it is desirable to provide a DST valve that is designed to act as a normal enclosed valve such as it closes automatically upon dissipation of formation pressure utilized to maintain it in an open condition.

Conventional drill string testing tools are normally open valves that are placed in the well or are then actuated by application of annulus pressure. The condition of such valves during installation provides significant insecurity that could be overcome by providing a normally closed drill string testing valve.

It is therefore a principal feature of the present invention to provide a normal drill string testing valve that is in the form of a shuttle valve that is capable of efficient movement between open and closed positions to provide for efficient well control under all flow conditions including conditions of well flow at extremely high rates.

It is another feature of this invention to provide a novel drill stem testing valve that is installed in the well in a hydraulically locked closed condition for purposes of safety and, after being installed, it easily hydraulically unlocked to provide the valve with the capability of being opened for flow test procedures by application of annulus pressure.

It is a further feature of this invention to provide a novel drill stem testing valve that is capable of efficient and safe closure at extremely high rates of well flow.

SUMMARY OF THE INVENTION

A downhole flow testing valve constructed in accordance with the present invention is designed for attachment into the production tubing string and for location at the production formation within the well casing of a well for producing petroleum products such as crude oil, gas, and other fluids. The flow testing valve, also referred to as a "DST" valve includes a housing structure that is secured and sealed with respect to the well casing by means of a packer assembly. Within the housing structure is disposed a movable flow tube having flow apertures that become registered with corresponding flow apertures formed in the housing and a sleeve valve surrounding the housing to thus allow flow from the annulus below the packer into the housing and flow tube for flow of production fluid through the tubing of the well to the surface for handling by surface flow control equipment. To establish flow through the valve the flow tube is moved upwardly in the housing under the influence of pressure applied from the annulus above the packer. For conditions of flow the flow tube is moved upwardly against the force developed by a nitrogen charge acting downwardly on a flow tube piston. Thus, when annulus pressure is reduced, the nitrogen charge automatically drives the flow tube downwardly thus causing closure of the shuttle valve mechanism.

During installation of the apparatus the shuttle valve mechanism is maintained in its closed condition by virtue of an external sleeve valve that is hydraulically locked in its closed position by means of hydraulic fluid trapped within a closed hydraulic chamber. After the valve mechanism has been properly installed in the well and sealed with respect to the well casing by the packer assembly, a drop bar or other suitable implement may be passed through the tubing string to the level of the shuttle valve where it is caused to break a frangible plug member and thus open the hydraulic chamber to the passage of the flow tube and housing to thus permit automatic opening of the sleeve valve by means of a compression spring provided therefore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIGS. 3A–3F are each partial sectional views of the downhole shuttle valve mechanism of the present invention, illustrating the shuttle valve with its flow tube and sleeve valve in the closed positions thereof such as during valve installation.

FIG. 4 is a sectional view taken along line 4–4 of FIG. 3A and illustrating apparatus for filling the nitrogen chamber prior to installation of the tool.

FIG. 5 is a sectional view taken along of FIG. 3C and illustrating the configuration of the upper locking dogs of the packer assembly.

FIGS. 6A–6C are each partial sectional views of the shuttle valve mechanism of FIGS. 3A–3E, illustrating the shuttle valve mechanism in its open condition permitting flow from the annulus below the packer into the flow tube and tubing string for purposes of flow testing.

FIG. 7 is a sectional view taken along lines of FIG. 6C and illustrating the registering apertures of the flow tube, housing and external valve sleeve in the open condition of the apparatus as shown in FIG. 6C.

DETAILED DESCRIPTION OF THE PREFERRED EMBODIMENT

Figure 1:
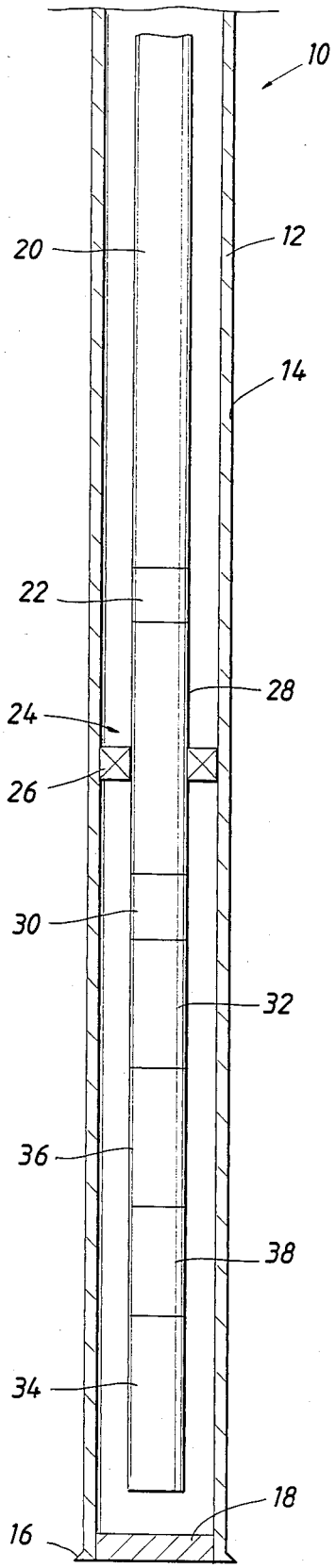
FIG. 1 is a vertical sectional view of a well at the formation level and illustrating a tubing string extending through the casing and being interconnected with a packer and flow tube assembly including a shuttle valve constructed in accordance with this invention and also being provided with other apparatus for well completion and control.

Referring now to the drawings and first to FIG. 1 a well assembly is shown generally at 10 which incorporates a casing 12 that extends through the well bore 14 to a production zone of the well. The casing is typically provided with a casing shoe 16 at its lower extremity and is typically closed at its lower extremity by means of a closure element 18, also referred to as a PBTD.

For completion of the well a tubing string 20 is extended through the casing and at its lower extremity includes various apparatus for well control. For example the tubing string will typically incorporate a reversing valve 22 having a packer assembly located therebelow. In the case of the present invention a packer and flow tube assembly 24 is connected into the tubing string immediately below the reversing valve and includes a packer assembly 26 and a flow tube assembly 28 that are disposed in integral relation. Below the packer and flow tube assembly are located a tubing joint 30 providing support for a gun firing mechanism 32 that is provided for operation and control of a series of perforating guns 34 which function to perforate the casing at the level of the production strata. Between the gun firing mechanism and the perforating guns are located a gauge carrier 36 and a shock absorber 38, the shock absorber protecting other downhole apparatus from damage upon firing of the explosive charges of the perforating guns.

Figure 2:
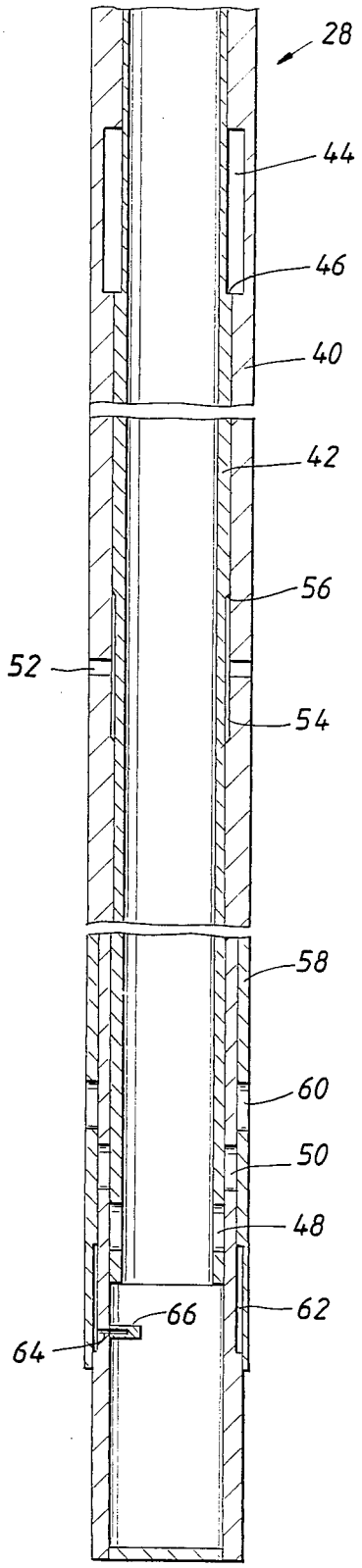
FIG. 2 is a simplified sectional view of a DST fail safe shuttle valve constructed in accordance with the present condition.

As shown in FIG. 2 a simplified presentation of the downhole shuttle valve or DST valve is illustrated. The valve mechanism illustrated generally at 28 incorporates a housing structure 40 having a flow tube movably disposed therein. A nitrogen charge within a nitrogen chamber 44 defined cooperatively by the housing 40 and the flow tube causes a nitrogen induced resultant force to act on the flow tube by virtue of the annular shoulder 46 thereby continuously urging the flow tube downwardly such that flow ports 48 located at the lower extremity of the flow tube are out of registry with fluid entry ports 50 defined in the housing structure. The flow tube is moved upwardly to its open position, moving fluid entry ports 48 and 50 into registry upon application of sufficient annulus pressure via pressure inlet ports 52 to overcome the downwardly acting force induced by the nitrogen or other gas on the flow tube. Annulus pressure enters pressure ports 52 and the annulus 54 between the flow tube and housing and acts against the annular shoulder 56 to impart sufficient upwardly directed force to the flow tube to move it upwardly against the influence of downwardly acting gas pressure in chamber 44.

At the lower portion of the valve mechanism an external sleeve valve 58 is provided, having fluid entry ports 60 that are ordinarily disposed in registry with fluid entry ports 50 of the housing after the valve mechanism has been placed into operation within the well. During installation, however, the condition shown in FIG. 2, the external sleeve valve 58 is maintained in its closed condition, placing fluid entry ports 50 and 60 out of registry by means of hydraulic fluid entrapped within a closed hydraulic chamber 62. A passage 64 from the closed hydraulic chamber 62 is normally blocked by means of a frangible plug 66, also referred to as a "break plug". The shuttle valve apparatus is thus introduced into the well in its closed condition by virtue of the closed sleeve valve 58 and also by virtue of the closed flow tube valve at the lower end of the flow tube. After the packer has been properly set and the tubing string with its downhole equipment is determined safe, a drop bar or other suitable implement is passed through the tubing string to the formation level where it engages and breaks the break plug 66 thus opening the closed hydraulic chamber 62 to the interior of the housing structure. When this occurs a compression spring acting on the sleeve valve 58 urges the sleeve valve downwardly to its open position. Thereafter, the shuttle valve mechanism may be opened by application of annulus pressure through pressure ports 52 and closed simply by reducing annulus pressure thus permitting closure of the shuttle valve by the force of the nitrogen charge within the chamber 44.

Referring now to FIGS. 3A–3F, a more detailed description of the present invention is described, with the valve mechanism being illustrated in its closed and locked condition, similar to the condition depicted in FIG. 2. The downhole shuttle valve mechanism incorporates an upper sub 70 which is threadedly connected to the lower end of the tubing string 20. The shuttle valve mechanism further incorporates a housing structure 40 which is secured to the lower end of the upper sub by means of threads 72 and by means of cap screws 74 that insure against unthreading of the housing from the upper sub. The housing is sealed with respect to the upper sub by means of O-rings 76. The upper sub 70 and the upper portion of the housing 40 form a receptacle 78 for receiving the upper end of the flow tube 42. A high pressure seal 80 such as a rod T seal establishes an efficient high pressure seal between the housing and the flow tube to prevent the loss of nitrogen or other suitable gas contained within the annular chamber 44 that is defined between the flow tube and housing. Although nitrogen is typically the gas that will be contained within chamber 44, such is not intended to restrict the present invention in any manner whatever. Other suitable gasses may be disposed within chamber 44 to provide a sufficient precharged pressure for inducing closure to the shuttle valve mechanism.

At the intermediate valve portion of FIG. 3A and also as shown in FIG. 4, the upper portion of the housing structure 40 receives a pressure retainer 82 and a fill plug 84 and defines appropriate passages 86, 88 and 90 for filling the annular chamber 44 with a nitrogen charge of sufficient pressure for closing the shuttle valve under any pressure conditions which might be encountered at formation level. With the pressure retainer 82 backed out and fill plug 84 removed gas charging apparatus may be threaded into the opening for the fill plug thus communicating the gas charging apparatus with the annular chamber 44 via passages 86 and 90. After the chamber 44 has been charged to the proper pressure the pressure retainer 82 will be moved to its closed position as shown in FIG. 4, thus positively sealing the high pressure gas within the annular chamber. After the gas injection apparatus has been unthreaded the fill plug 84 is returned to its secured position as shown in FIG. 4, thus further securing the nitrogen charge in place. Passage 88 functions as a vent passage permitting full seating of the fill plug 84 without unduly increasing pressure within the passage 86. Thus, the O-ring seals of the pressure retainer provide efficient blocking of any pressure leakage from passage 90.

As shown in FIG. 3B, the upper section 41 of the housing 40 is secured by threads 92 to an intermediate housing section 94 and is sealed with respect to the intermediate housing section by means of O-rings 96. Cap screws 98 provide positive insurance against inadvertent unthreading of the threaded connection 92. At the lower end of the upper flow tube section 43 an enlargement 100 is formed, defining an annular shoulder 102 and forming a large diameter cylindrical surface 104 that is sealed with respect to the upper housing section by means of a high pressure sealing element 106 which may for example be in the form of a rod T seal. Sealing element 106 also establishes positive assurance against any leakage of pressurized gas from the gas chamber 44 but also permits linear movement of the flow tube 40 relative to the housing structure while maintaining appropriate seals. Since the diameter of high pressure seal 106 is greater than the diameter of high pressure seal 80 the pressure of gas within chamber 44 acting on the seal areas 80 and 106 develops a resultant force on the shoulder 102 of the flow tube thereby normally urging the flow tube downwardly to its closed condition .

The flow tube 40 incorporates a lower flow tube section 108 that is secured by a threaded connection 110 to the lower end of the upper flow tube section 43. Sealing elements such as O-rings 112 establish a positive seal between the upper and lower flow tube sections to prevent any leakage therebetween. The lower flow tube section 108 forms a stepped down shoulder 114 with a reduced diameter portion 116 thereof extending below the shoulder 114. Conversely, the intermediate housing section 94 defines a step shoulder 118 with a reduced diameter passage 120 therebelow. These different diameters of the flow tube and housing define the annular chamber 54 mentioned above in connection with FIG. 2. Pressure from the annulus 122 between the well casing 12 and the intermediate housing section 94 of the shuttle valve housing enters the annular chamber 54 via injection ports 52 and provides for opening of the shuttle valve. A high pressure seal 122 such as a rod T seal establishes high pressure seal between the intermediate housing section 94 and the lower section 108 of the flow tube. This injected pressure then passes upwardly along the flow tube to the high pressure seal member 106. Since the high pressure seals 106 and 122 are of different dimension, the injected pressure acting upon these respective surface areas of different dimension, develops a resultant force acting upon the flow tube and tending to urge the flow tube upwardly. As soon as the force of injected pressure overcomes the force developed by the charge of gas pressure in chamber 44 acting downwardly on the flow tube, the flow tube will be moved upwardly, thus moving the valve mechanism toward its open position.

Figure 3C:
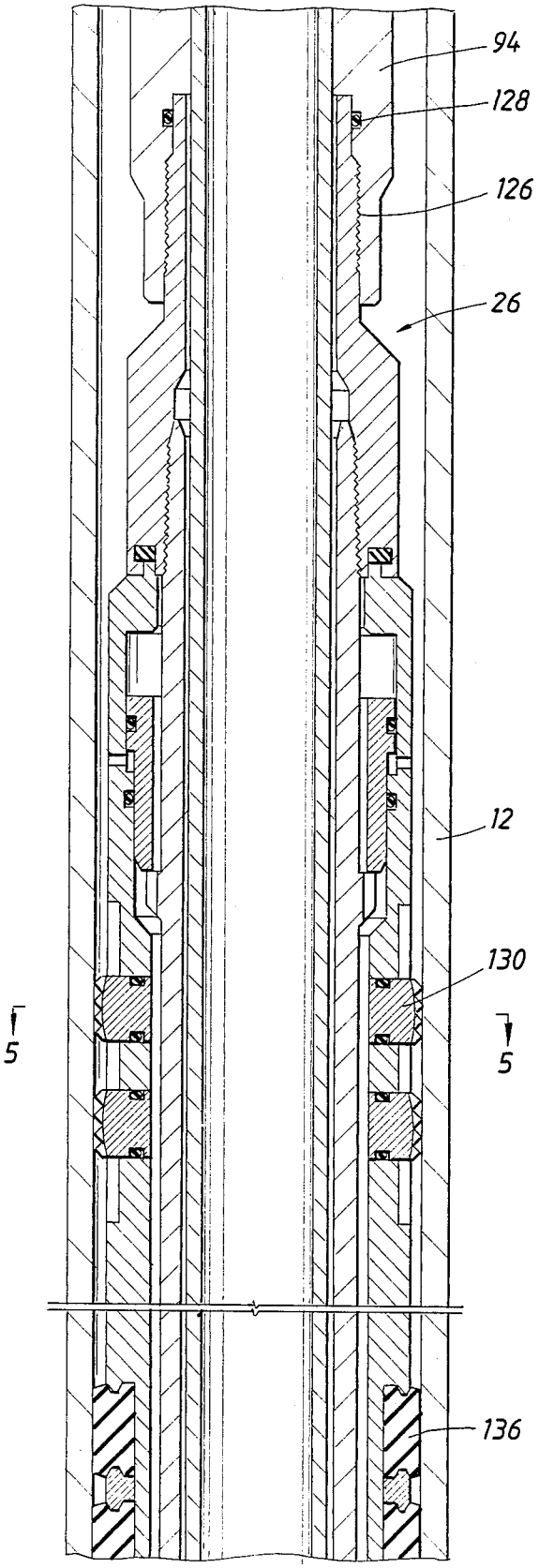

As shown in FIG. 3C the intermediate housing section 94 is connected at its lower extremity to a packer assembly illustrated generally at 26. The packer assembly is secured by threads 126 to the lower end of the intermediate housing section and is sealed with respect thereto by means of an O-ring seal 128. The packer assembly incorporates a plurality of locking dogs 130 that engage and lock the apparatus with respect to the inner wall surface of the casing 12. The packer assembly is also provided with lower locking dogs 132 which may be in the form of slips that are actuated by a downwardly facing surface 134 for establishing a gripping relation with the inner wall surface of the casing. Between the upper and lower locking dogs are provided a plurality of packer sealing elements 136. The packer assembly is centralized with respect to the casing by means of spring biased centralizing shoes 138. Likewise, the housing structure of the shuttle valve assembly is centralized with respect to the packer assembly by means of inwardly directed spring biased centralizing shoes 140.

Figure 3D:
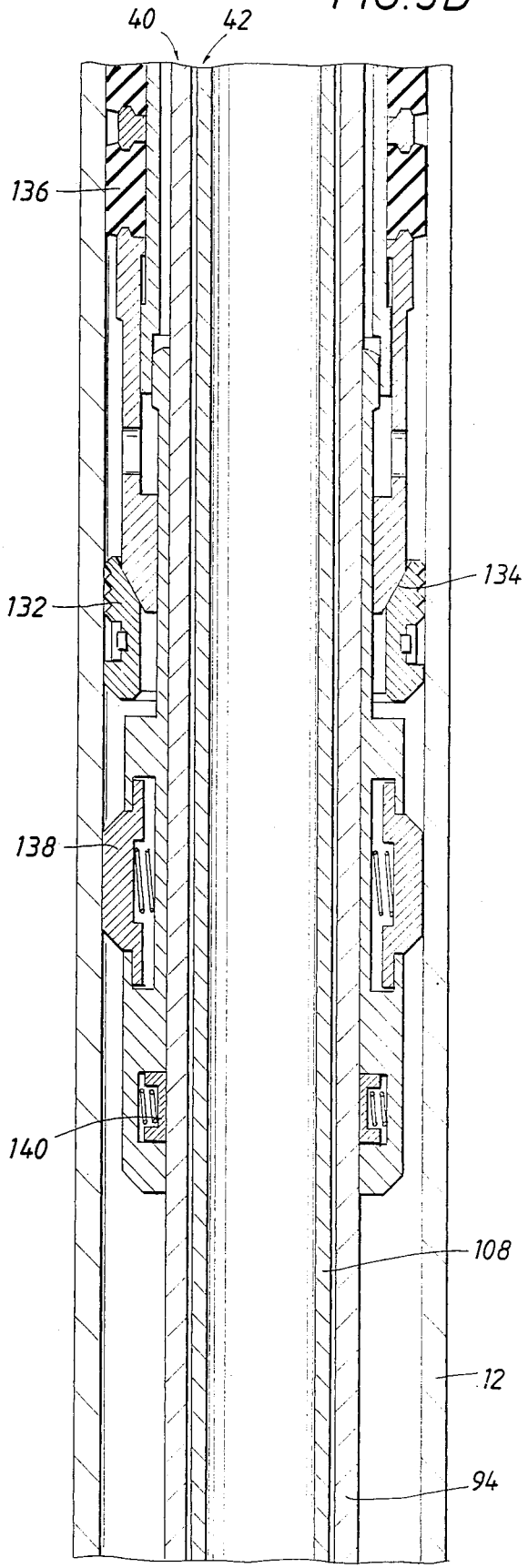
Figure 3E:
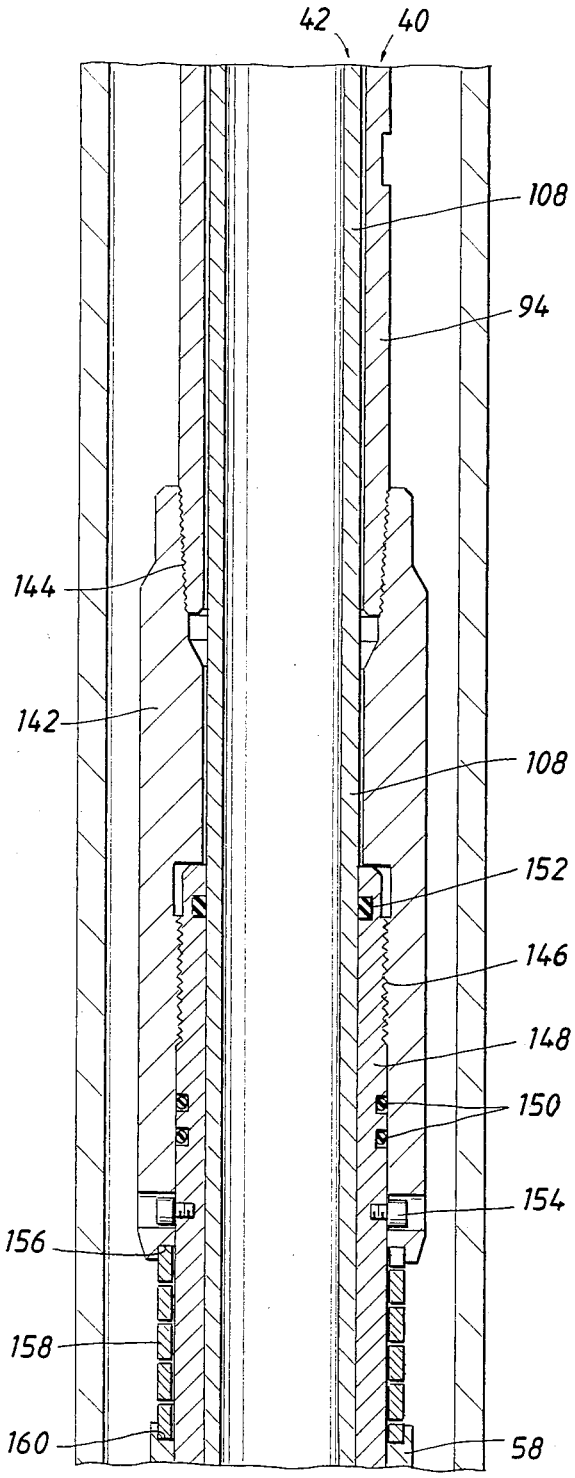
Figure 3F:
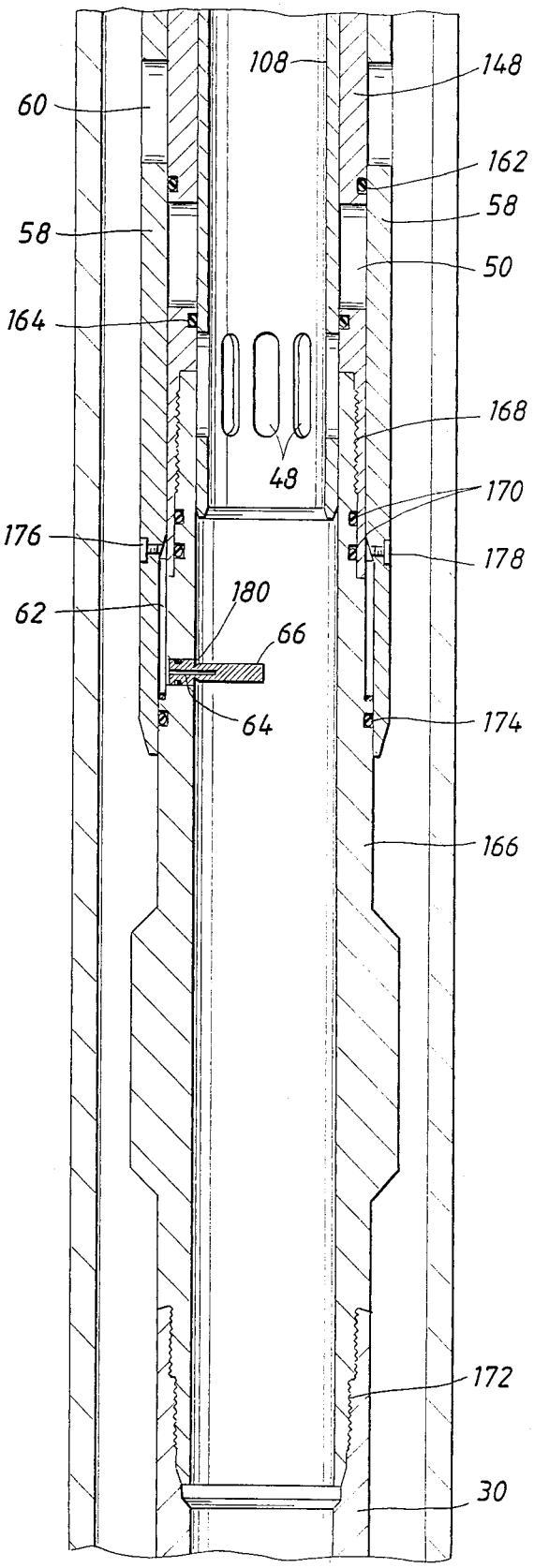

The intermediate housing section 94 and the lower flow tube section 108 of flow tube 42 extend below the level of the packer assembly as shown in FIGS. 3D and 3E. A valve sub 142 is connected by threads 144 to the lower end of the intermediate housing section and provides threaded support at 146 with a valve mandrel 148. O-ring sealing elements 150 provide an efficient fluid tight seal between the sub 142 and the mandrel 148 while a high pressure seal 152 such as a rod T seal establishes positive sealing between the valve mandrel 148 and the lower section 108 of the flow tube 42. Cap screws 154 secure the sub 142 and the mandrel 148 against relative rotation and thus assure against inadvertent unthreading thereof. The lower end of the valve sub 142 is provided with a downwardly facing recess 156 which functions as a retainer for the upper end of a valve operating compression spring 158. The lower end of the spring 158 is received within an upwardly facing spring recess formed at the upper end of the sleeve valve 58. As mentioned above, the sleeve valve 58 incorporates a plurality of fluid entry ports 60 that, in the closed condition of the valve as shown in FIG. 3F are disposed out of fluid communicating registry with respective fluid entry ports 50 of the valve mandrel 148. To prevent leakage between the fluid entry ports an O-ring seal 162 establishes a seal between the sleeve valve 58 and the valve mandrel 148. Likewise a sealing element 164 establishes a seal between the valve mandrel 148 and the lower section 108 of the flow tube. At the uppermost position of the flow tube the fluid entry ports of the flow tube are disposed slightly below the level of the sealing element 164.

The housing structure of the valve assembly is completed by means of a lower sub 166 which is connected by threads 168 to the valve mandrel 148. Sealing elements 170 provide a positive seal between the lower sub 166 and the mandrel 148. Below the bottom sub 166 is connected the tubing joint 30 by means of a threaded connection 172.

Figure 6A:
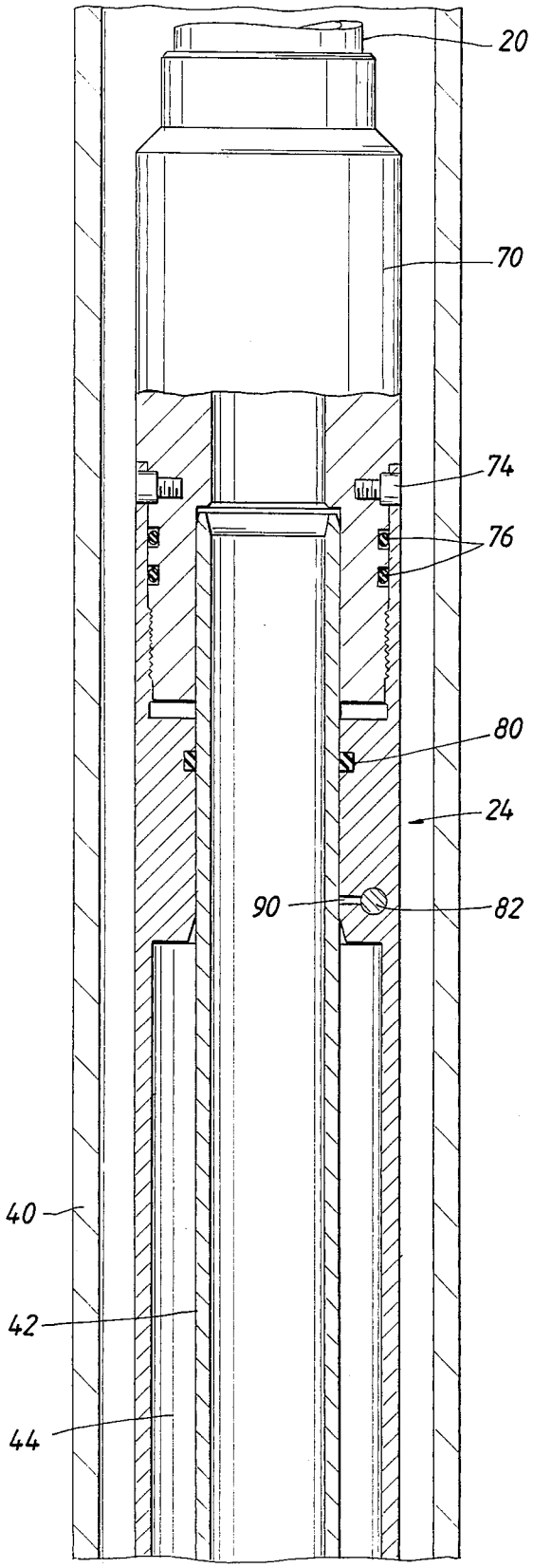
Figure 6B:
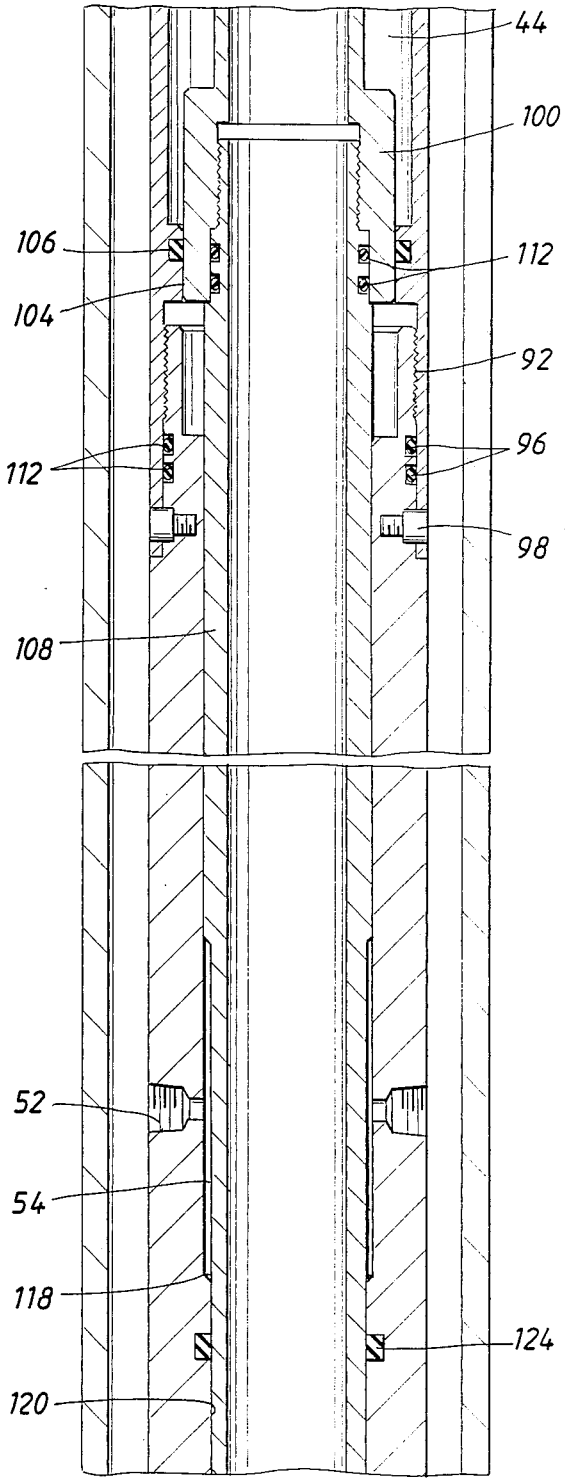

The closed hydraulic chamber 62 is defined by an annulus between the lower sub 166 and the interior surface of the lower portion of the sleeve valve 58. A sealing element 174, together with sealing elements 170 ensure against inadvertent leakage from the closed hydraulic chamber. The hydraulic chamber is provided with openings receiving fill screws 176 and 178 which enable hydraulic fluid to be injected into the chamber 62 while the sleeve valve is maintained in its closed position as shown in FIG. 3F. After hydraulic fluid has been installed within the chamber 62 and the frangible break plug 166 is secured in place, leakage of hydraulic fluid from the chamber 62 will be prevented. This hydraulic fluid will retain the sleeve valve in its closed position as shown in FIGS. 2 and 3F until the valve assembly has been properly installed in the well and its safe condition has been assured. Thereafter, a drop bar or other suitable element is brought into contact with the break plug, causing it to break at its weakened point 180 adjacent the inner wall of the bottom sub. When this occurs, hydraulic fluid will pass through the passage 64 and will be expelled from the chamber 62 by virtue of the force applied by the compression spring 158. As soon as the break plug 66 has been broken, the sleeve valve 58 will be urged by the spring 58 from its closed position as shown in FIG. 3F to its open position as shown in FIG. 6C. Thereafter, the sleeve 58 will remain in the position shown in FIG. 6 and opening and closure of the valve assembly will be accomplished simply upon movement of the flow tube from the closed position shown in FIG. 3F to the open position shown in FIG. 6C.

OPERATION

With the pressure in the annulus between the casing and the tubing string at a condition of low pressure the pressurized nitrogen or other gas within the chamber 44 will induce a resultant force to the flow tube, urging the flow tube downwardly to its closed condition as shown in FIG. 3F. The external sleeve valve 58 by virtue of the broken break plug 66 will be disposed in its open condition, registering fluid entry ports 50 and 60. A condition of zero flow will exist because the fluid entry ports 48 at the lower end of the flow tube assembly will be disposed in their closed position, out of registry with the fluid entry ports 50. When it is desired to achieve a condition of flow through the shuttle valve mechanism, pressure is introduced in the annulus between the casing and tubing and by virtue of injection ports 52 enters the annular chamber 54 and acts upon the different flow tubes diameters defined by high pressure fluid seals 106 and 124. Since seal 106 is significantly greater in diameter than the diameter of seal 124 a pressure induced resultant force will be developed on the flow tube, urging the flow tube upwardly. When the annulus pressure has been decreased sufficiently to overcome the downwardly induced force induced by the pressurized nitrogen or other gas within chamber 44, the flow tube will be permitted to move upwardly, thereby causing the fluid entry ports 48 of the flow tube to move past the O-ring seal 164 and move into registry with the fluid inlet port 50 of the lower housing section 148. As soon as this begins to occur, fluid pressure within the annulus below the packer will then enter the inner passage of the flow tube by means of the registering ports 48, 50 and 60. Since the registering fluid entry ports are of elongate configuration the flow of fluid can be efficiently controlled simply by controlling the position of the fluid entry ports 48 of the flow tube relative to the fluid entry ports 50 of the lower housing section. When in complete registry the fluid entry ports 48 and 50 will permit flow at maximum volume and velocity through the tubing string and to the surface.

If a dangerous condition develops during flow testing, the valve will be come automatically closed, thereby shutting in the well simply upon bleeding pressure from the annulus above the level of the packer. The valve mechanism is therefore efficient and safe in its operation and is easily operated between open and closed position to control the flow of fluid from the formation through the tubing string. The position of the flow tube may be carefully adjusted relative to the housing to thereby efficiently control the volume of flow from the formation into the tubing string.

In view of the foregoing, it is apparent that the present invention is adapted to attain all of the objects and features herein set forth together with other features that are inherent in the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit and scope thereof, it is to be understood that all matters hereinabove set forth or shown in the accompanying drawings are to be interpreted as illustrative and not in any limiting sense.

What is claimed is:

1. A downhole flow testing valve for installation in a well bore having a casing lining the well bore and having a casing pressure therein, comprising:

(a) tubular body means adapted for connection to a conduit extending through the said casing of said wellbore and defining an internal passage and production fluid inlet port means and actuating fluid port means intersecting said internal passage;

(b) means for securing said tubular body means within said casing and forming a packing seal with said casing, said packing seal being located intermediate the length of said tubular body means;

(c) tubular valve means being disposed for reciprocation within said tubular body means and forming valve port means disposed for registry with said inlet port means at the open position of said tubular valve means and being disposed out of registry with said inlet port means at the closed position of said tubular valve means;

(d) means for forming first and second chambers between said tubular body means and said tubular valve means, said first chamber being charged with pressurized gas developing a gas induced force urging said tubular valve means toward said closed position thereof, said second chamber being in communication with the pressure in the casing externally of said tubular body means whereby casing pressure in excess of a predetermined minimum develops a resultant force urging said tubular valve means toward said open position thereof;

(e) sleeve valve means disposed about said tubular body means and defining fluid inlet port means for registry with said fluid inlet port means of said tubular body means at the open position of said sleeve valve means;

(f) means urging said sleeve valve means toward the open position thereof; and (g) means locking said sleeve valve means in the closed position thereof, said locking means being selectively releasable to permit movement of said sleeve valve means to said open position by said urging means.

2. A downhole testing valve as recited in claim 1, wherein:

(a) said fluid inlet port means comprises a plurality of elongated ports disposed in spaced annular side by side relation about said tubular body means; and (b) said valve port means comprises a plurality of elongate ports disposed in spaced annular side by side relation about said tubular valve means and oriented for registry with said plurality of elongated ports of said tubular body means at the open position of said tubular valve means.

3. A downhole testing valve as recited in claim 2, including:

seal means establishing a seal between said tubular body means and said tubular valve means and preventing fluid communication between said inlet port means and said valve port means at the closed position of said tubular valve means.

4. A downhole testing valve as recited in claim 1, wherein:

said tubular valve means forms a straight through passage of sufficient dimension for passage of well service tools therethrough.

5. A downhole testing valve as recited in claim 1, wherein said means for securing said tubular body means within said casing comprises:

a packer assembly having spaced locking dogs for establishing mechanical gripping of said packer assembly with said casing and having annular sealing means for sealing engagement with said casing.

6. A downhole testing valve as recited in claim 1, wherein:

(a) said tubular valve means defines an external enlargement located intermediate the extremities thereof and forming a cylindrical external sealing surface;

(b) intermediate seal means establishing a seal between said tubular body means and said cylindrical external sealing surface; and (c) upper and lower seal means establishing seals between said tubular body means and said tubular valve means, said upper and lower seal means each being of smaller diameter than said intermediate seal means and defining opposed differential areas exposed to respective pressures within said first and second chambers.

7. A downhole testing valve as recited in claim 1, wherein:

said upper and lower seal means respectively define the upper and lower limits of said first and second chambers and said intermediate seal means separates said first and second chambers.

8. A downhole testing valve as recited in claim 1, wherein said means comprises::

(a) a valve locking chamber being cooperatively defined by said tubular body means and said sleeve valve means;

(b) hydraulic fluid being disposed within said valve lock chamber and locking said sleeve valve against movement by said urging means; and (c) fluid release means being selectively actuatable for permitting flow of said hydraulic fluid from said locking chamber.

9. A downhole testing valve as recited in claim 8, wherein said fluid release means comprises:

a frangible plug member being received by said tubular body means and extending into said internal passage of said tubular body means, said frangible plug member adapted to be fractured by an implement moving downwardly through said internal passage and, upon being fractured, communicating said locking chamber and said internal passage and permitting ejection of said hydraulic fluid from said locking chamber by opening movement of said sleeve valve under the influence of said urging means.

10. A downhole testing valve for installation in a well bore having casing lining the wellbore and having a casing pressure therein received from the production formation intersected by the wellbore, comprising:

(a) tubular body means adapted for connection to a conduit extending through the said casing of said wellbore and defining an internal passage and having production fluid inlet port means and actuating fluid port means, said tubular body means adapted for sealing with respect to said casing at a location below said actuating fluid port means and above said production fluid inlet port means;

(b) tubular valve means being disposed for reciprocation within said tubular body means and forming valve port means disposed for registry with said inlet port means at the open position of said tubular valve means and being disposed out of registry with said inlet port means at the closed position of said tubular valve means;

(c) means urging said tubular valve means toward said closed position thereof relative to said tubular body means;

(d) said tubular body means and said tubular valve means cooperating to define an actuating chamber in communication with said actuating fluid port means, said tubular valve means having a pressure responsive shoulder, fluid pressure within said actuating chamber acting on said pressure responsive shoulder and developing a resultant force urging said tubular valve means toward said open position thereof;

(e) a sleeve valve means being disposed about said tubular body means and defining fluid inlet port means for registry with said fluid inlet port means of said tubular body means at the open position of said sleeve valve means; and (f) means urging said sleeve valve means toward the open position thereof.

11. The downhole testing valve recited in claim 10, including:

(a) a valve locking chamber being cooperatively defined by said tubular body means and said sleeve valve means;

(b) hydraulic fluid being disposed within said valve locking chamber and locking said sleeve valve means against movement by said urging means; and (c) fluid release means being selectively actuatable for permitting flow of said hydraulic fluid from said locking chamber to permit movement of said sleeve valve means to said open position by said urging means.

12. The downhole testing valve recited in claim 11, wherein said fluid release means comprises:

a frangible plug member being received by tubular body means and extending into said internal passage of said tubular body means, said frangible plug member adapted to be fractured by an implement moving downwardly through said internal passage and, upon being fractured, communicating said locking chamber and said internal passage and permitting ejection of said hydraulic fluid from said locking chamber by movement of said sleeve valve means under the influence of said urging means.

13. The downhole testing valve recited in claim 10, wherein:

(a) said tubular body means and said tubular valve means cooperate to define a compressed gas chamber therebetween;

(b) said tubular valve means defining a pressure responsive area in communication with said compressed gas chamber whereby compressed gas within said compressed gas chamber develops a resultant force urging said tubular valve means toward said closed position thereof relative to said tubular body means; and (c) said tubular valve means being maintained at said open position thereof relative to said tubular body means when the pressure responsive force developed on said tubular valve means by pressure within said actuating chamber exceeds the pressure responsive force developed on said tubular valve means by gas pressure within said pressurized gas chamber.

14. A downhole testing valve as recited in claim 10, wherein:

(a) said fluid inlet port means comprises a plurality of elongated ports disposed in spaced annular side by side relation about said tubular body means; and (b) said valve port means comprises a plurality of elongated ports disposed in spaced annular side by side relation about said tubular valve means and oriented for registry with said plurality of elongated ports of said tubular body means at the open position of said tubular valve means.

15. A downhole testing valve as recited in claim 14, including:

seal means establishing a seal between said tubular body means and said tubular valve means and preventing fluid communication between said inlet port means and said valve port means in the closed position of said tubular valve means.

16. A downhole testing valve as recited in claim 10, wherein:

said tubular valve means forms a straight through passage of sufficient dimension for passage of well service tools therethrough.

17. A downhole testing valve as recited in claim 10, wherein said means securing said tubular body means within the casing comprises:

a packer assembly having spaced locking dogs for establishing mechanical gripping of said packer assembly with said casing and having annular sealing means for sealing engagement with said casing.

18. A downhole testing valve as recited in claim 13, wherein:

(a) said tubular valve means defines an external enlargement located intermediate the extremities thereof and forming a cylindrical external sealing surface;

(b) intermediate seal means establishing seals between said tubular body means and said cylindrical external sealing surface; and (c) upper and lower seal means establishing seals between said tubular body means and said tubular valve means, said upper and lower seal means each being of smaller diameter than said intermediate seal means and defining opposed differential areas exposed to respective pressures within said compressed gas chamber and said actuating chamber.

19. A downhole testing valve as recited in claim 18, wherein:

said upper and lower seal means respectively define the upper and lower limits of said gas and actuating chambers and said intermediate seal means separates said gas and actuating chambers.

* * * * *